US007589580B2

(12) United States Patent
Lee et al.

(10) Patent No.: US 7,589,580 B2
(45) Date of Patent: Sep. 15, 2009

(54) REFERENCE CURRENT GENERATING METHOD AND CURRENT REFERENCE CIRCUIT

(75) Inventors: Ho-suk Lee, Hwaseong-si (KR); Jae-goo Lee, Yongin-si (KR); Young-hyun Jun, Gangnam-gu (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 48 days.

(21) Appl. No.: 11/797,865

(22) Filed: May 8, 2007

(65) Prior Publication Data

US 2007/0273352 A1 Nov. 29, 2007

(30) Foreign Application Priority Data

May 26, 2006 (KR) ..... 10-2006-0047529

(51) Int. Cl.
*G05F 1/10* (2006.01)

(52) U.S. Cl. ..... 327/513; 327/538

(58) Field of Classification Search ..... 327/512–513, 327/539

See application file for complete search history.

(56) References Cited

U.S. PATENT DOCUMENTS 5,396,115 A * 3/1995 Coffman et al. ..... 327/143
5,631,600 A * 5/1997 Akioka et al. ..... 327/543
5,977,813 A * 11/1999 Boerstler ..... 327/378
5,994,945 A * 11/1999 Wu et al. ..... 327/378
6,160,390 A * 12/2000 Gheeraert et al. ..... 323/312
6,166,590 A * 12/2000 Friedman et al. ..... 327/543
6,281,760 B1 * 8/2001 Koelling et al. ..... 331/66
6,714,080 B2 * 3/2004 Burns ..... 330/288
6,717,878 B2 * 4/2004 Hagura et al. ..... 365/211
6,859,079 B2 * 2/2005 Haraguchi et al. ..... 327/156
6,956,397 B2 * 10/2005 Lim et al. ..... 326/31
7,288,983 B1 * 10/2007 Schwartsglass et al. ..... 327/513
2001/0050410 A1 * 12/2001 Aswell ..... 257/536
2005/0128017 A1 * 6/2005 Meltzer ..... 331/176

FOREIGN PATENT DOCUMENTS

JP 2003-256056 9/2003
KR 1020010048984 A 6/2001

* cited by examiner

*Primary Examiner*—Lincoln Donovan
*Assistant Examiner*—Thomas J Hiltunen
(74) *Attorney, Agent, or Firm*—Volentine & Whitt, PLLC

(57) ABSTRACT

Provided are a reference current generating method and a current reference circuit. The reference current generating method includes generating a first current using a NMOS transistor and a second current using a PMOS transistor, calculating a current difference between the first and second currents, generating a third current which has a similar current/temperature slope as the second current by multiplying the current difference by a proportional constant, and generating a reference current by subtracting the third current from the second current.

8 Claims, 4 Drawing Sheets

REFERENCE CURRENT GENERATING METHOD AND CURRENT REFERENCE CIRCUIT

BACKGROUND OF THE INVENTION

1. Field of the Invention

The present invention relates to semiconductor devices. More particularly, the invention relates to a method of generating a reference current and a current reference circuit implementing the method.

This application claims the priority of Korean Patent Application No. 10-2006-0047529, filed on May 26, 2006, the subject matter of which is hereby incorporated by reference.

2. Description of the Related Art

The performance characteristics of contemporary semiconductor devices are carefully defined in relation to a fairly narrow range of applied operating voltages and currents. The operating voltages and currents allow proper operation of the electrical circuits within semiconductor devices and must remain stable across a range of operating temperatures. One type of circuit commonly providing stable current over a range of operating conditions is referred to as a current reference circuit.

Most conventional current reference circuits generate a constant reference current irrespective of operating temperature change by compensating for a first current component proportional to absolute temperature and a second current component inversely proportional to absolute temperature. Examples of conventional reference circuits are disclosed, for example, in U.S. Pat. No. 5,990,727 and U.S. Pat. No. 6,693,332.

FIG. 1 is a diagram of an exemplary band gap reference circuit which is commonly used in conventional current reference circuits. Referring to FIG. 1, the band gap reference circuit is implemented with resistors R1 and R2 and diodes Q1-Q3 and generates a reference voltage (REF) and a corresponding reference current.

The band gap reference circuit includes a PTAT generating unit 11 generating a PTAT current component (I_PTAT) and a CTAT generating unit 13 generating a CTAT current component (I_CTAT). The PTAT generating unit 11 includes PMOS transistors P1-P3, NMOS transistors N1 and N2, a resistor R1, and bipolar transistors Q1 and Q2. The CTAT generating unit 13 includes a resistor R2 and a bipolar transistor Q3.

With this circuit configuration, a PTAT current component (I_PTAT), which is proportional to changes in temperature, flows to the PMOS transistor P3 of the PTAT generating unit 13, and a CTAT current component (I_CTAT), which is inversely proportional to the change in temperature, flows through the resistor R2 of the CTAT generating unit 13. Thus, the PTAT current component (I_PTAT) and the CTAT current component (I_CTAT) provide temperature compensation to generate the reference voltage (REF) and the corresponding reference current.

As described above, conventional current reference circuits such as the band gap reference circuit require separate circuits for generating the PTAT current component and the CTAT current component. For this reason, when conventional current reference circuits are implemented in contemporary semiconductor devices, they occupy a disproportionately large area within the device. In addition, the use of resistors within the conventional current reference circuits may lead to mismatches caused by variations in process used to fabricate the resistor, variations in the respective voltages applied to the resistors, as well as circuit local temperature variations. Such mismatches have the potential to interfere with proper operation of the conventional current reference circuit.

SUMMARY OF THE INVENTION

Embodiments of the invention provide a reference current generating method and a related circuit within a semiconductor integrated circuit occupying a relatively small chip area. The current reference circuit, according to embodiments of the invention, provide enhanced immunity to variations in operating conditions, yet do not suffer the potential resistor mismatch problems associated with similar conventional circuits.

In one embodiment, the invention provides a reference current generating method comprising; generating a first current using an NMOS transistor and generating a second current using a PMOS transistor, calculating a current difference between the first and second currents, generating a third current which has a similar current/temperature slope as the second current by multiplying the current difference by a proportional constant, and generating a reference current by subtracting the third current from the second current.

In another embodiment, the invention provides a current reference circuit comprising; a first current generating unit generating a first current using an NMOS transistor, a second current generating unit generating a second current using a PMOS transistor, a current difference generating unit generating a current difference between the first and second currents, a third current generating unit generating a third current which has a similar current/temperature slope as the second current by multiplying the current difference by a proportional constant, and a reference current generating unit generating a reference current by subtracting the third current from the second current.

DESCRIPTION OF EMBODIMENTS

Figure 1:
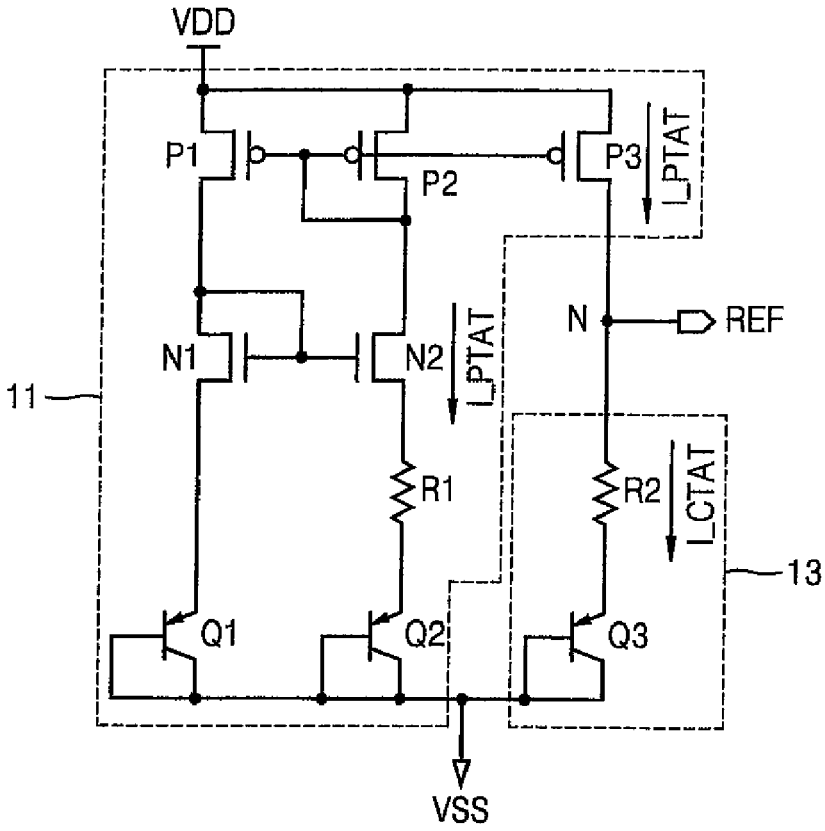
FIG. 1 (prior art)
FIG. 1 is a diagram of an exemplary band gap reference circuit such as those commonly used in conventional current reference circuits.

Several embodiments of the invention will be described with reference to the attached drawings. Throughout the written description and drawings, like reference numerals denote like or similar elements.

Those of ordinary skill in the art will recognize that the illustrated embodiments are selected examples of the invention which may be otherwise embodied. Indeed, numerous circuit and method variations are contemplated within the scope of the invention, as defined by the following claims.

Figure 2A:
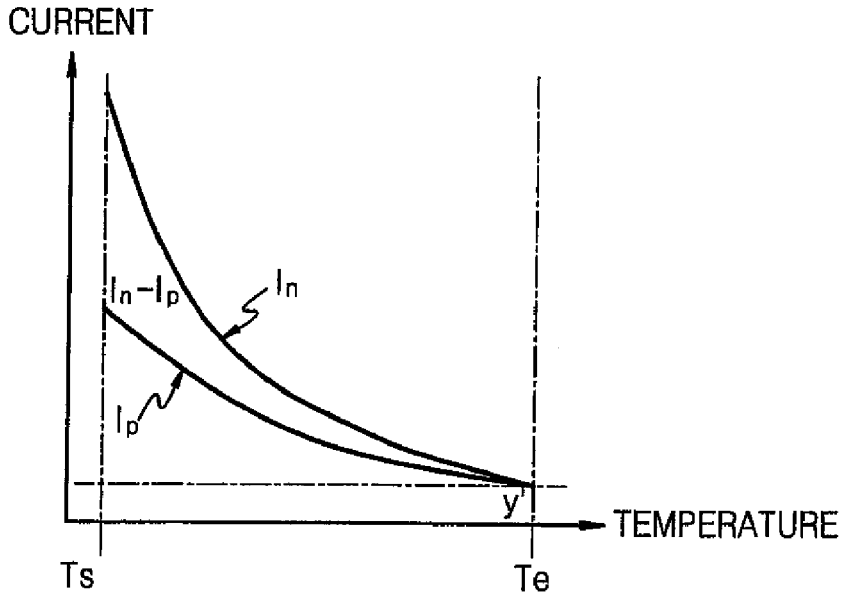
FIGS. 2A through 2C are graphs illustrating the operational concept of a reference current generating method and circuits according to an embodiment of the invention.
Figure 2B:
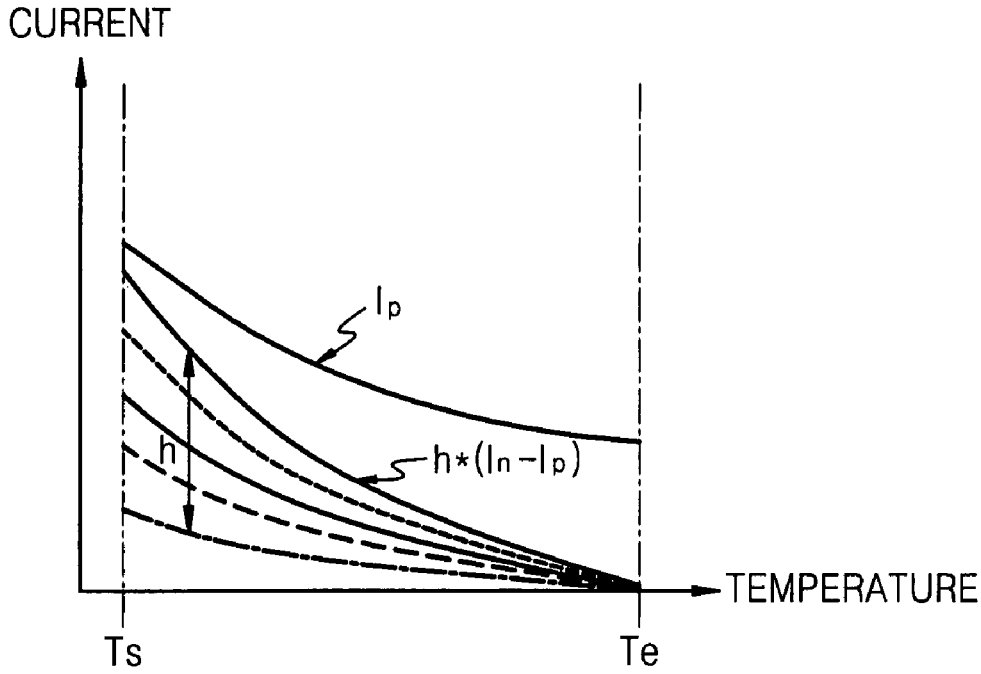
Figure 2C:
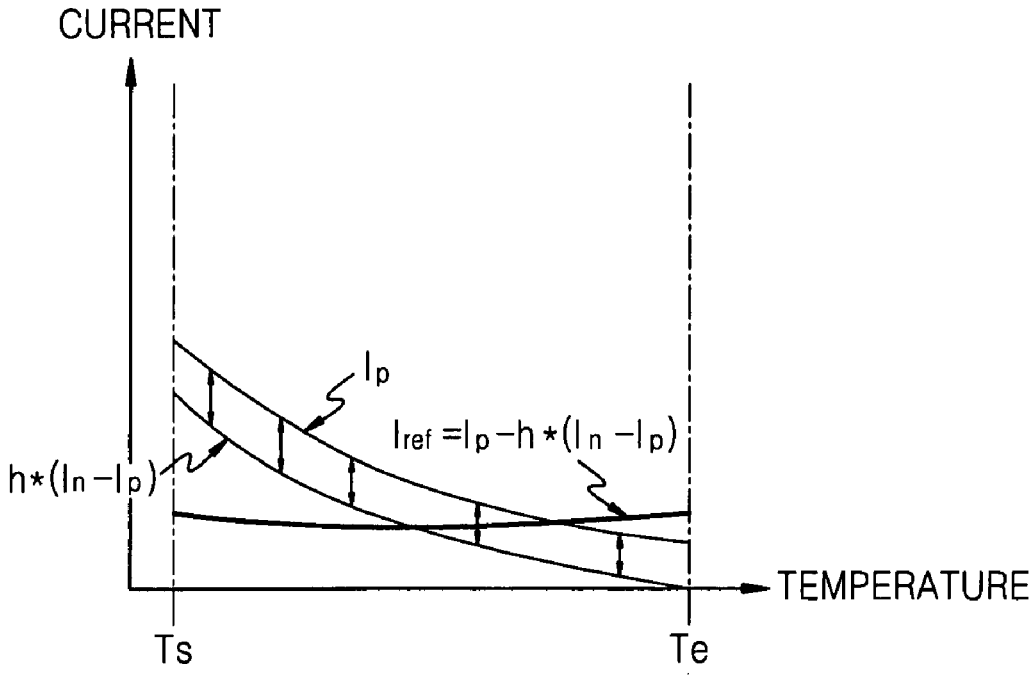

FIGS. 2A through 2C are graphs illustrating the basic operation concept of a reference current generating method according to an embodiment of the invention. FIG. 2A is a graph of the current characteristics for various transistors with respect to temperature. FIG. 2B is a graph of current that varies with respect to a constant (h). FIG. 2C is a graph of reference current which is unaffected by a change in temperature.

Referring to FIG. 2A, one current characteristic (Ip) for a PMOS transistor with respect to temperature, and another current characteristic (In) for an NMOS transistor with respect to temperature have different slopes due to different mobilities and threshold voltages associated with the different transistor types. For example, a PMOS transistor and an NMOS transistor designed to have the same current at one arbitrary temperature point (Te) will none the less have different current/temperature characteristics at temperatures below arbitrary temperature Te, e.g., temperatures down to temperature Ts. In other words, there is a difference (In−Ip) between the currents associated with the NMOS transistor and the PMOS transistor at temperatures below the arbitrary temperature Te.

Referring to FIG. 2B, the current difference (In−Ip) is "0" at the arbitrary temperature Te and gradually increases as temperature falls further from the arbitrary temperature Te. Current curves (h*(In−Ip)) with different slopes can be obtained at the temperature Te with y=0 by multiplying the current difference (In−Ip) by a given proportional constant (h).

A reference current (Iref) may thus be defined by the equation:

$$Iref=Ip-[h*(In-Ip].$$

This reference current is almost constant irrespective of a change in temperature and may be obtained by determining the proportional constant (h) that results in a current/temperature slope for the derived current curve (h*(In−Ip)) that is similar to the current/temperature slope of current curve (Ip) associated with the PMOS transistor, and then subtracting the product h*(In−Ip) from the current curve (Ip). See, FIG. 2C.

Figure 3:
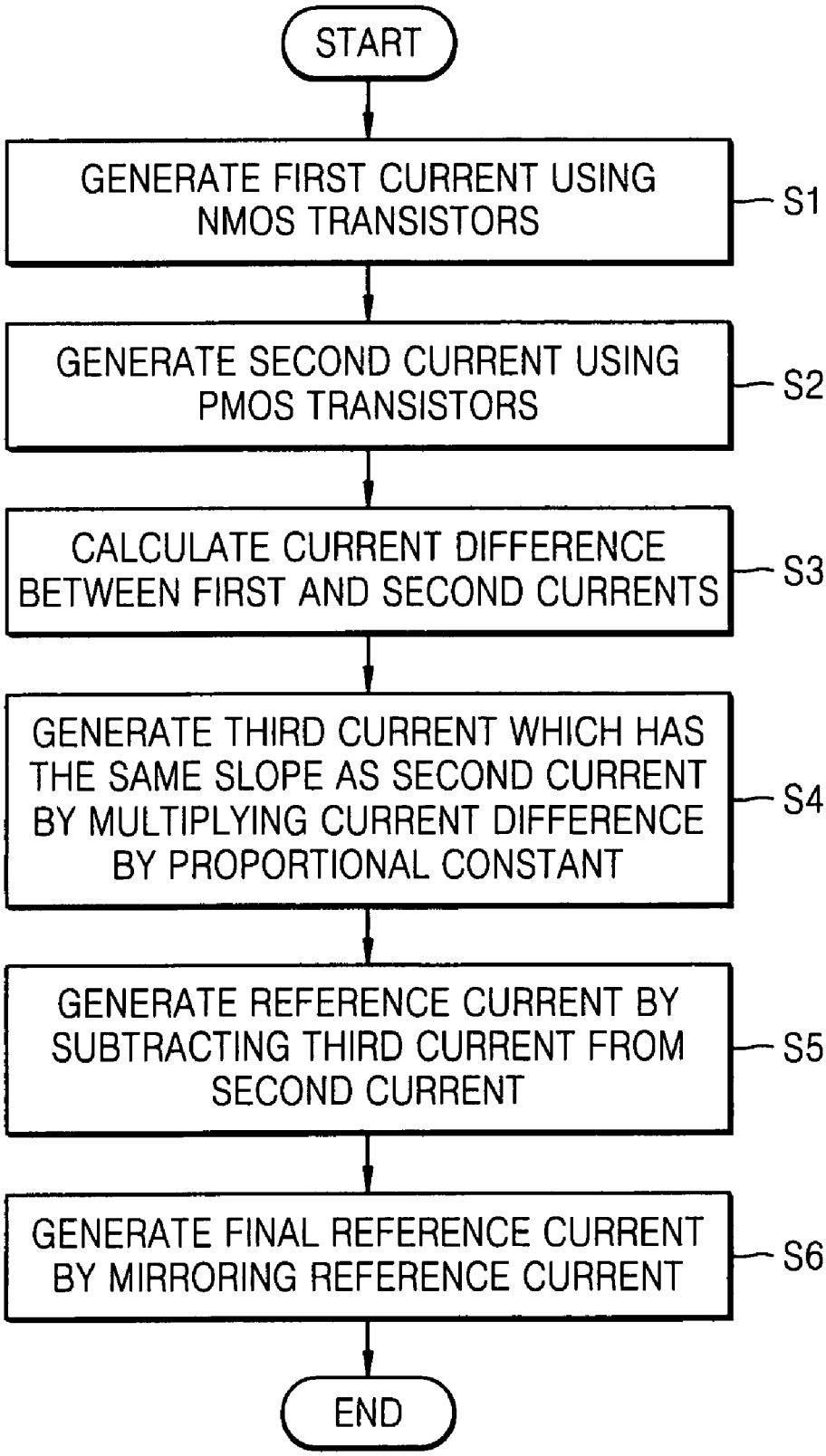
FIG. 3 is a flowchart summarizing a reference current generating method according to an embodiment of the invention.

FIG. 3 is a flowchart of a reference current generating method according to an embodiment of the invention. As will be apparent, the operation concepts illustrated in FIGS. 2A through 2C may be implemented by the exemplary reference current generating method illustrated in FIG. 3.

Referring to FIG. 3, a first current is generated using an NMOS transistor (S1). That is, a first current (In) associated with the NMOS transistor (FIG. 2A) is generated. A second current is also generated using a PMOS transistor (S2). That is, a second current (Ip) associated with the PMOS transistor (FIG. 2A) is generated. Then, a current difference (In−Ip) between the first current (In) and the second current (Ip) is calculated (S3).

In one embodiment of the invention, the calculation of the current difference (In−Ip) includes obtaining a first mirror current that has the same level as the first current (In) by mirroring the first current (In), obtaining a second mirror current that has the same level as the first current (Ip) by mirroring the second current (Ip); and obtaining the current difference (In−Ip) by subtracting the second mirror current from the first mirror current.

Next, a third current having the same slope as the second current (Ip), i.e., a current (h*(In−Ip)) in FIG. 2B is obtained by multiplying the current difference (In−Ip) by a proportional constant (h) (S4). In one embodiment of the invention, obtaining the third current (h*(In−Ip)) includes mirroring the current difference (In−Ip).

Next, a reference current (Iref=Ip−h*(In−Ip)) in FIG. 2C is generated by subtracting the third current (h*(In−Ip)) from the second current (Ip) (S5). Finally, a final reference current is generated by mirroring the reference current (Iref=Ip−h*(In−Ip)) (S6).

As described above, in the reference current generating method according to an embodiment of the invention, since the slope of the second current (Ip) and the slope of the third current (h*(In−Ip)) are the same, the reference current (Iref=Ip−h*(In−Ip)), which corresponds to the difference between the two currents, has an almost constant level irrespective of a change in temperature.

Figure 4:
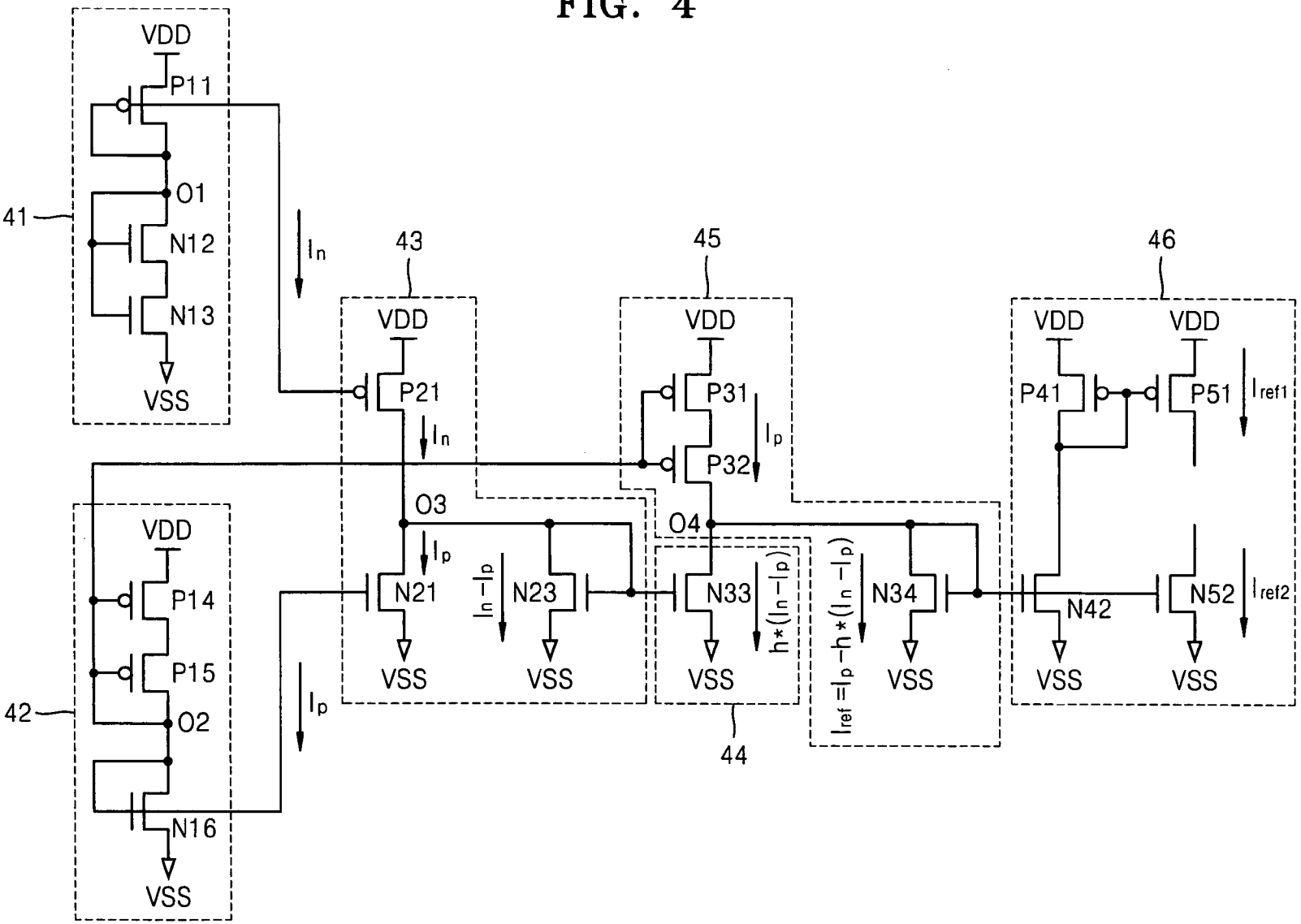
FIG. 4 is a circuit diagram of a current reference circuit according to an embodiment of the invention and may be used to implement the reference current generating method of FIG. 3.

FIG. 4 is a circuit diagram of a current reference circuit according to an embodiment of the invention. This circuit is one example of a class of circuits capable of implementing the reference current generating method of FIG. 3.

Referring to FIG. 4, the current reference circuit includes a first current generating unit 41, a second current generating unit 42, a current difference generating unit 43, a third current generating unit 44, a reference current generating unit 45, and a final reference current generating unit 46.

The first current generating unit 41 generates a first current (In) using an NMOS transistor. The second current generating unit 42 generates a second current (Ip) using a PMOS transistor. Since final reference currents Iref1 and Iref2 are generated from the first current (In) and the second current (Ip), the first and second current generating units 41 and 42 are implemented so as for variations in the first current (In) and the second current (Ip) with respect to temperature to be small.

The current difference generating unit 43 is coupled to an output node O1 of the first current generating unit 41 and an output node O2 of the second current generating unit 42 and generates a current difference (In−Ip) between the first current (In) and the second current (Ip). In particular, the current difference generating unit 43 generates a first mirror current (In) which has the same level as the first current (In) by mirroring the first current (In), generates a second mirror (Ip) which has the same level as the second current (Ip) by mirroring the second current (Ip), and generates the current difference by subtracting the second mirror current (Ip) from the first mirror current (In).

The third current generating unit 44 is coupled to an output node O3 of the third current generating unit 44 and generates a third current (h*(In−Ip)) which has the same slope as the second current (Ip) by multiplying the current difference (In−Ip) by a proportional constant (h).

The reference current generating unit 45 is coupled to an output node O4 of the third current generating unit 45 and the output node O2 of the second current generating unit 42 and generates a reference current (Iref=Ip−h*(In−Ip)) by subtracting the third current (h*(In−Ip)) from the second current (Ip).

The final reference current generating unit 46 is coupled to the reference current generating unit 45 and generate the final reference currents reference current (Iref1 and Iref2) by mirroring the reference current (Iref=Ip−h*(In−Ip)).

Since the above-described current reference circuit is designed such that the slope of the second current (Ip) is the same as the slope of the third current (h*(In−Ip)), the reference current (Iref=Ip−h*(In−Ip)), which corresponds to the difference between these two currents, has an almost constant level irrespective of a change in temperature.

The structure of each element of the above-described current reference circuit will now be described in some additional detail. The first current generating unit 41 includes a first PMOS transistor P11, a first NMOS transistor N12, and a second NMOS transistor N13. The first PMOS transistor P11 has a source receiving an applied power voltage (VDD), and a source and a drain which are commonly coupled to the output node O1 of the first current generating unit 41. The first NMOS transistor N12 has a drain and a gate which are commonly coupled to the output node O1. The second NMOS transistor N13 has a drain coupled to a source of the first NMOS transistor N12, a gate coupled to the output node O1, and a source connected to ground (VSS).

The second current generating unit 42 includes a second PMOS transistor P14, a third PMOS transistor P15, and a third NMOS transistor N16. The second PMOS transistor P14 has a source receiving applied power voltage (VDD), and a gate coupled to the output node O2 of the second current generating unit 42. The third PMOS transistor P15 has a source coupled to a drain of the second PMOS transistor P14, and a gate and a drain which are commonly coupled to the output node O2. The third NMOS transistor N16 has a drain and a gate which are commonly coupled to the output node O2, and a source connected to ground (VSS).

The current different generating unit 43 includes a fourth PMOS transistor P21, a fourth NMOS transistor N21, and a fifth NMOS transistor N23. The fourth PMOS transistor P21 has a source receiving applied power voltage (VDD), a gate coupled to the output node O1 of the first current generating unit 41, and a drain coupled to the output node O3 of the current different generating unit 43. The fourth NMOS transistor N21 has a drain coupled to the output node O3, a gate coupled to the output node of the second current generating unit 42, and a source connected to ground (VSS). The fifth NMOS transistor N23 has a drain and a gate which are commonly coupled to the output node O3, and a source connected to ground (VSS).

The first PMOS transistor P11 of the first current generating unit 41 and the fourth PMOS transistor P21 of the current difference generating unit generate a mirror current. The size of the first PMOS transistor P11 is designed to be the same as the size of the fourth PMOS transistor P21. Accordingly, the level of the first mirror current (In) flowing through the fourth PMOS transistor P21 is the same as the level of the first current (In) flowing through the first PMOS transistor P11.

In addition, the third NMOS transistor N16 of the second current generating unit 42 and the fourth NMOS transistor N21 of the current difference generating unit generates a mirror current. Here, the size of the third NMOS transistor N16 is designed to be the same as the size of the fourth NMOS transistor N21. Accordingly, the level of the second mirror current (Ip) flowing through the fourth NMOS transistor N21 is the same as the level of the second current (Ip) flowing through the third NMOS transistor N16. As a result, the level of a current which corresponds to the current difference (In−Ip) between the first mirror current (In) and the second mirror current (Ip) flows through the fourth NMOS transistor N23.

The third current generating unit 44 includes a sixth NOMS transistor N33. The sixth NMOS transistor N33 has a drain coupled to an output node O4 of the third current generating unit 44, a gate coupled to the output node O3 of the third current generating unit 44, i.e., the gate of the fifth NMOS transistor N23, and a source connected to ground (VSS).

The fifth NMOS transistor N23 and the sixth NMOS transistor N33 generate a mirror current. Here, the size of the sixth NMOS transistor N33 is designed to be h (proportional constant) times than the size of the fifth NMOS transistor N23. Accordingly, a third current (h*(In−Ip)) that is h times larger than the amount of the current (In−Ip) flowing through the fifth NMOS transistor N23 flows through the sixth NMOS transistor N33. The proportional constant h is determined for the slope of the third current (h*(In−Ip)) to be equal to the slope of the second current (Ip).

The reference current generating unit 45 includes a fifth PMOS transistor P31, a sixth PMOS transistor P32, and a seventh NMOS transistor N34. The fifth PMOS transistor P31 has a source receiving applied power voltage (VDD) and a gate coupled to the output node O2 of the second current generating unit 42. The sixth PMOS transistor P32 has a source coupled to a drain of the fifth PMOS transistor. P31, a gate coupled to the gate of the fifth PMOS transistor P31, and a drain coupled to an output node of the reference current generating unit 45. The output node of the reference current generating unit 45 is coupled to the output node O4 of the third current generating unit 44. The seventh NMOS transistor N34 has a drain and a gate which are commonly coupled to the output node O4 of the reference current generating unit 45, and a source connected to ground (VSS).

The second and third PMOS transistors P14 and P15 of the second current generating unit 42 and the fifth and sixth PMOS transistors P31 and P32 of the reference current generating unit 45 generate a mirror current. Here, the size of the second and third PMOS transistors P14 and P15 are designed to be the same as the size of the fifth and sixth PMOS transistors P31 and P32. Accordingly, the level of the mirror current (Ip) flowing through the fifth and sixth PMOS transistors P31 and P32 is the same as the level of the second current (Ip). As a result, a reference current (Iref=Ip−h*(In−Ip)) that corresponding to the current difference between the mirror current (Ip) and the third current (h*(In−Ip)) flows through the seventh NMOS transistor N34.

As described above, since the slope of the current (Ip) and the slope of the third current (h*(In−Ip)) are the same, the reference current (Iref=Ip−h*(In−Ip)) has an almost constant value irrespective of a change in temperature.

The final reference current generating unit 46 includes an eighth NMOS transistor N42, a seventh PMOS transistor P41, an eighth PMOS transistor P51, and a ninth NMOS transistor N52. The eighth NMOS transistor N42 has a gate coupled to the output node O4 of the reference current generating unit 45 and a source connected to ground (VSS). The seventh PMOS transistor P41 has a source receiving applied power voltage (VDD), and a gate and a grain which are commonly coupled to a drain of the eighth NMOS transistor N42. The eighth PMOS transistor P51 has a source receiving applied power voltage (VDD), a gate coupled to the gate of the seventh PMOS transistor P41, and a drain through which a first final reference current (Iref1) flows. The ninth NMOS transistor N52 has a gate coupled to the gate of the eighth NMOS transistor N42, a source connected to ground (VSS), and a grain through which a second final reference current (Iref2) flows.

The eighth NMOS transistor N42 of the final reference current generating unit 46 and the seventh NMOS transistor N34 of the reference current generating unit 45 generate a mirror current. The ninth NMOS transistor N52 of the final reference current generating unit 46 and the seventh NMOS transistor N34 of the reference current generating unit 45 generate a mirror current. In addition, the seventh PMOS transistor P41 and the eighth PMOS transistor P51 generate a mirror current.

As described above, in a reference current generating method and a current reference circuit according embodiments of the invention, a difference in the mobility of carriers associated with PMOS and NMOS transistors, (i.e., the difference in temperature-dependent current characteristic between PMOS and NMOS transistors) are used for the purpose of temperature compensation. Accordingly, circuits generating the conventionally used PTAT and CTAT current components are not required. Thus, semiconductor devices incorporating the embodiments of the invention save increasingly scarce chip space. In addition, the reference current generating method and corresponding current reference circuit according to embodiments of the invention may be implemented using only CMOS components instead of resistors. Thus, the potential for resistive component mismatch is eliminated.

While the present invention has been particularly shown and described with reference to exemplary embodiments thereof, it will be understood by those of ordinary skill in the art that various changes in form and details may be made therein without departing from the scope of the present invention as defined by the following claims.

What is claimed is:

1. A current reference circuit comprising:

a first current generating unit generating a first current having a first current characteristic over a temperature range using an NMOS transistor, wherein the first current generating unit comprises:

a first PMOS transistor having a source receiving an applied power voltage, and a gate and a drain commonly coupled to an output node of the first current generating unit;

a first NMOS transistor having a drain and a gate commonly coupled to the output node of the first current generating unit; and a second NMOS transistor having a drain coupled to a source of the first NMOS transistor, a gate coupled to the output node of the first current generating unit, and a source connected to ground;

a second current generating unit generating a second current having a second current characteristic over the temperature range using a PMOS transistor, wherein the first and second current characteristics are distinguished by different first and second current-to-temperature slopes over the temperature range, respectively;

a current difference generating unit having input terminals connected to output terminals of the first and second current generating units and generating a current difference between the first and second currents over the temperature range;

a third current generating unit having an input terminal connected to an output terminal of the current difference generating unit and generating a third current having a third current characteristic different from the first and second current characteristic over the temperature range, wherein the third current characteristic has a third current-to-temperature slope similar to the second current-temperature slope of the second current by multiplying the current difference by a proportional constant;

a reference current generating unit having an input terminal connected to the output terminal of the second current generating unit and generating a reference current by subtracting the third current from the second current; and a final reference current generating unit having an input terminal connected to the output terminal of the reference current generating unit and generating first and second final reference currents in response to the reference current, wherein the first and second final reference currents vary in an inverse relationship one to another.

2. The current reference circuit of claim 1, wherein the current difference generating unit generates the current difference by generating first and second mirror currents having the same respective levels as the first and second currents by mirroring the first and second currents and subtracting the second mirror current from the first mirror current.

3. The current reference circuit of claim 1, wherein the third current generating unit generates the third current by mirroring the current difference in relation to a multiple of the proportional constant.

4. A current reference circuit, comprising:

a first current generating unit generating a first current having a first current characteristic over a temperature range using an NMOS transistor, wherein the first current generating unit comprises:

a first PMOS transistor having a source receiving an applied power voltage, and a gate and a drain commonly coupled to an output node of the first current generating unit;

a first NMOS transistor having a drain and a gate commonly coupled to the output node of the first current generating unit; and a second NMOS transistor having a drain coupled to a source of the first NMOS transistor, a gate coupled to the output node of the first current generating unit, and a source connected to ground;

a second current generating unit generating a second current having a second current characteristic over the temperature range using a PMOS transistor, wherein the first and second current characteristics are distinguished by different first and second current-to-temperature slopes over the temperature range, respectively and the second current generating unit comprises:

a second PMOS transistor having a source receiving the applied power voltage, and a gate coupled to an output node of the second current generating unit;

a third PMOS transistor having a source coupled to a drain of the second PMOS transistor, and a gate and a drain commonly coupled to the output node of the second current generating unit; and a third NMOS transistor having a drain and a gate commonly coupled to the output node of the second current generating unit, and a source connected to ground;

a current difference generating unit having input terminals connected to output terminals of the first and second current generating units and generating a current difference between the first and second currents over the temperature range;

a third current generating unit having an input terminal connected to an output terminal of the current difference generating unit and generating a third current having a third current characteristic different from the first and second current characteristic over the temperature range, wherein the third current characteristic has a third current-to-temperature slope similar to the second current-temperature slope of the second current by multiplying the current difference by a proportional constant;

a reference current generating unit having an input terminal connected to the output terminal of the second current generating unit and generating a reference current by subtracting the third current from the second current; and a final reference current generating unit having an input terminal connected to the output terminal of the reference current generating unit and generating first and second final reference currents in response to the reference current, wherein the first and second final reference currents vary in an inverse relationship one to another.

5. The current reference circuit of claim 4, wherein the current difference generating unit comprises:

a fourth PMOS transistor having a source receiving the applied power voltage, a gate coupled to the output node of the first current generating unit, and a drain coupled to an output node of the current difference generating unit;

a fourth NMOS transistor having a drain coupled to an output node of the current difference generating unit, a gate coupled to the output node of the second current generating unit, and a source connected to ground; and a fifth NMOS transistor having a drain and a gate commonly coupled to the output node of the current difference generating unit, and a source connected to ground.

6. The current reference circuit of claim 5, wherein the third current generating unit comprises:

a sixth NMOS transistor having a drain coupled to an output node of the third current generating unit, a gate coupled to the output node of the current difference generating unit, and a source connected to ground.

7. The current reference circuit of claim 6, wherein the reference current generating unit comprises:

a fifth PMOS transistor having a source receiving the applied power voltage, and a gate coupled to the output node of the second current generating unit;

a sixth PMOS transistor having a source coupled to a drain of the fifth PMOS transistor, a gate coupled to the gate of the fifth PMOS transistor, and a drain coupled to the output node of the reference current generating unit; and a seventh NMOS transistor having a drain and a gate commonly coupled to the output node of the reference current generating unit, and a source connected to ground, wherein the output node of the reference current generating unit is coupled to the output node of the third current generating unit.

8. The current reference circuit of claim 7, wherein the final reference current generating unit comprises:

an eighth NMOS transistor having a gate coupled to the output node of the reference current generating unit and a source connected to ground;

a seventh PMOS transistor having a source receiving the applied power voltage, and a gate and a drain commonly coupled to a drain of the eighth NMOS transistor;

an eighth PMOS transistor having a source receiving the applied power voltage, a gate coupled to a gate of the seventh PMOS transistor, and a drain through which a first final reference current flows; and a ninth NMOS transistor having a gate coupled to the gate of the eighth NMOS transistor, a source connected to ground, and a drain through which a second final reference current flows.

* * * * *